United States Patent [19]

Singeetham

[11] Patent Number: 5,069,288

[45] Date of Patent: Dec. 3, 1991

[54] SINGLE TRIP CASING HANGER/PACKOFF RUNNING TOOL

[75] Inventor: Shiva P. Singeetham, Houston, Tex.

[73] Assignee: FMC Corporation, Chicago, Ill.

[21] Appl. No.: 638,876

[22] Filed: Jan. 8, 1991

[51] Int. Cl.[5] ..... E21B 23/02; E21B 43/10

[52] U.S. Cl. ..... 166/348; 166/382; 166/208

[58] Field of Search ..... 166/123, 208, 181, 182, 166/348, 382

[56] References Cited

U.S. PATENT DOCUMENTS

| | | | |
|---|---|---|---|
| 3,809,158 | 5/1974 | Bonds et al. | 166/285 |
| 4,597,448 | 7/1986 | Baugh | 166/348 |
| 4,836,288 | 6/1989 | Wester | 166/348 |
| 4,880,061 | 11/1989 | Ahlstone | 166/348 |
| 4,928,769 | 5/1990 | Milberger et al. | 166/382 |
| 5,013,187 | 5/1991 | MacIntyre et al. | 166/348 |

*Primary Examiner*—Terry L. Melius

*Attorney, Agent, or Firm*—W. William Ritt, Jr.; Richard B. Megley

[57] ABSTRACT

A well tool assembly for running a casing hanger and a packoff into a wellhead housing during a single trip into the well, comprising a tubular inner mandrel, a locking mandrel, an outer annular body surrounding and rotatably connected to the inner mandrel, an outer sleeve surrounding the outer body, and means to prevent relative rotation between the outer body and the locking mandrel.

20 Claims, 7 Drawing Sheets

14
12
10
18
58
16
16
52
52
50
56
50
54
64
20
22
22
26
68
30
32
82
28
24
13
31
29
101
91
34
107
41
40
82
80
36
100
106
38
96
94
90
90
98
12
98

SINGLE TRIP CASING HANGER/PACKOFF RUNNING TOOL

BACKGROUND OF THE INVENTION

This invention relates to running tools for installing casing hangers and annulus packoffs in a subsea wellhead housing, and more particularly to such tools that facilitate running a hanger and a packoff together in a single trip into the well.

In subsea or other underwater well drilling procedures an established practice is to run, land and set casing hangers and annulus packoffs in the submerged wellhead housing by means of a running tool connected to a drill string or other pipe string. The hanger and packoff are releasably connected to the running tool to facilitate retrieval of the tool after the hanger and packoff have been set in the wellhead housing, and advances in this technology have produced running tools that enable the operator to accomplish those tasks during a single trip into the well. As the search for offshore oil deposits progresses into deeper water areas the costs thereof escalate dramatically, thereby continuing the need for tools that function more efficiently and procedures that are less time-consuming.

SUMMARY OF THE INVENTION

Broadly considered, the present invention comprises an improved running tool for installing a casing hanger and a packoff in a wellhead housing during a single trip into the well. The tool comprises a tubular inner mandrel with means to connect it to a pipe string, an annular outer body surrounding the inner mandrel and rotatably connected thereto, an outer sleeve surrounding and releasably secured to the outer body, a tubular locking mandrel surrounding the inner mandrel with its upper portion located between the inner mandrel and the outer body, a tubular inner body surrounding the inner mandrel and surrounded by the locking mandrel, spring-biased anti-rotation pins between the outer body and the locking mandrel, spring-biased lock pins in the outer body to releasably secure a packoff to the tool, an expandable split lock ring on the inner body to releasably secure a casing hanger to the tool, spring-biased anti-rotation pins in the inner body to prevent its rotation with respect to the casing hanger, and anti-rotation keys on the inner body cooperating with axial slots in the locking mandrel to prevent relative rotation between that body and mandrel yet facilitate relative axial movement therebetween.

Installation of an annulus packoff on the running tool is accomplished by rotating the tool's outer body to extend the lock pins into an inner annular groove in the packoff, this rotation also permitting the anti-rotation pins in the outer body to move into functional locking engagement with adjacent axial grooves in the locking mandrel, thereby preventing further relative rotation between that body and mandrel. The tool is then attached to a casing hanger by left hand rotation of the inner mandrel, causing axial movement of the locking mandrel with respect to the inner body and expansion of the lock ring into an inner annular groove in the hanger. After running and landing the hanger in the wellhead housing the running string is rotated to the right, thereby rotating and unthreading the inner mandrel from the locking mandrel. The inner mandrel, outer body and packoff are then lowered as a unit until the packoff lands on a support shoulder on the hanger or other location in the wellhead housing, and the weight of the running string and tool inner mandrel, outer body and outer sleeve imposed on the packoff to energize and set it in functional sealing position between the hanger and housing. Depending upon the type of packoff, further energization thereof can be achieved by closing the blowout preventer (BOP) rams around the running string and pressurizing the space between those rams and the tool's outer body, causing further downward movement of the outer body and outer sleeve and resulting in additional energizing forces on the packoff. The tool can then be retrieved for further use by simply lifting the running string to withdraw the tool from the hanger, packoff and wellhead housing.

DESCRIPTION OF THE PREFERRED EMBODIMENT

Figure 1A:
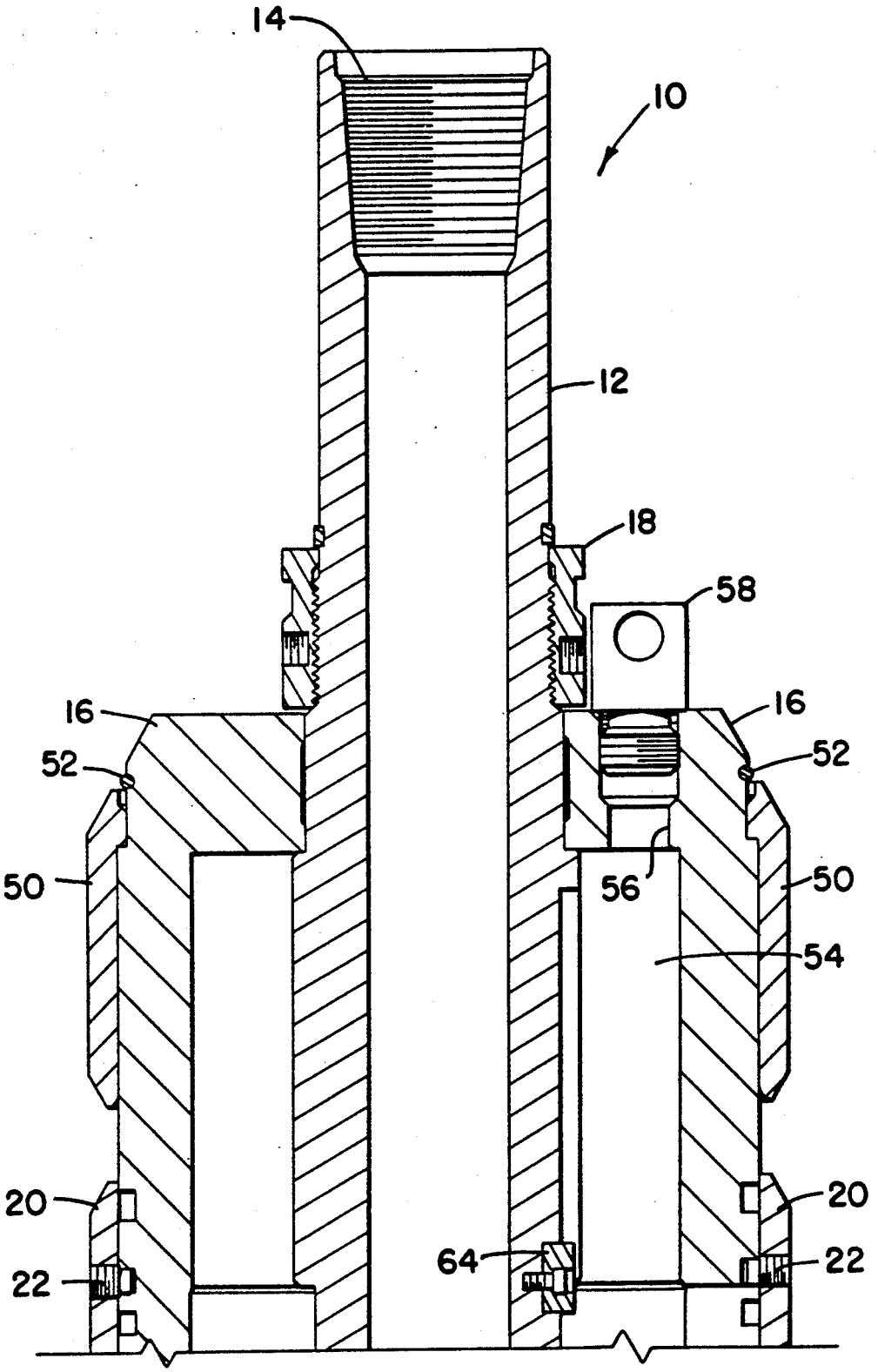
FIGS. 1A and 1B together constitute a view in central vertical section of a single trip casing hanger and packoff running tool according to the present invention.
Figure 1B:
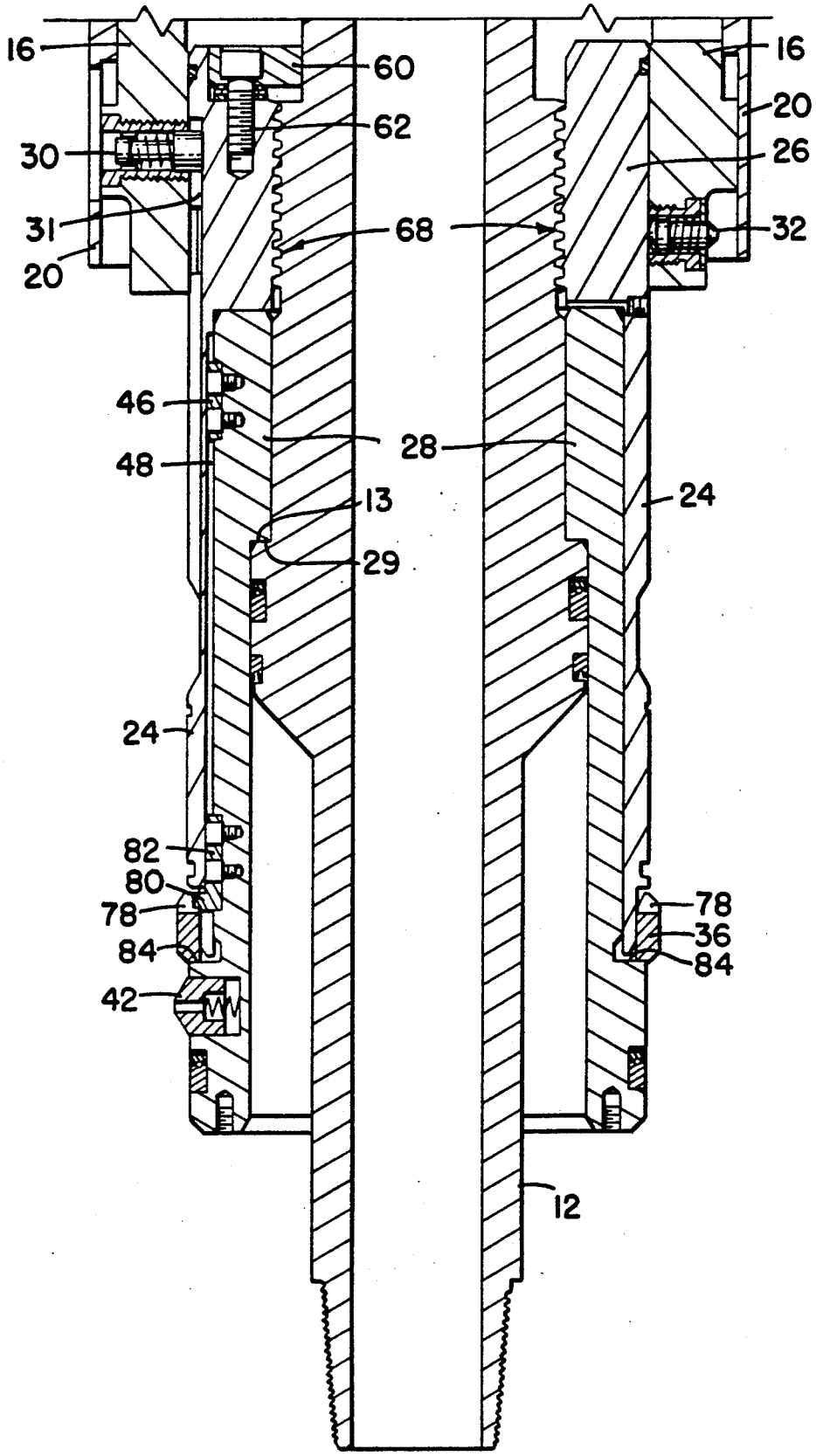
Figure 2A:
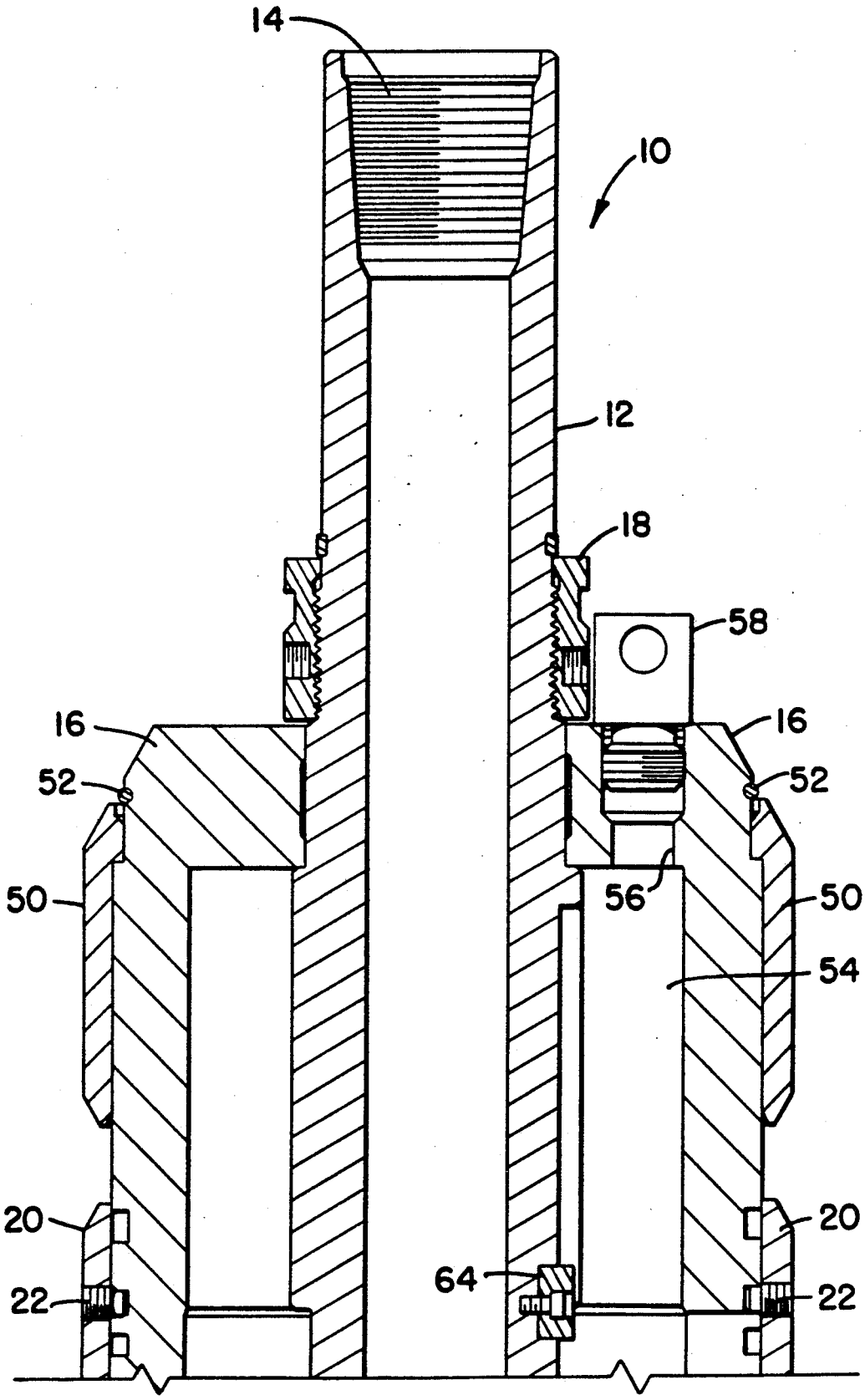
FIGS. 2A and 2B together constitute a view like FIGS. 1A and 1B, but also showing a casing hanger and a packoff attached to the running tool.
Figure 2B:
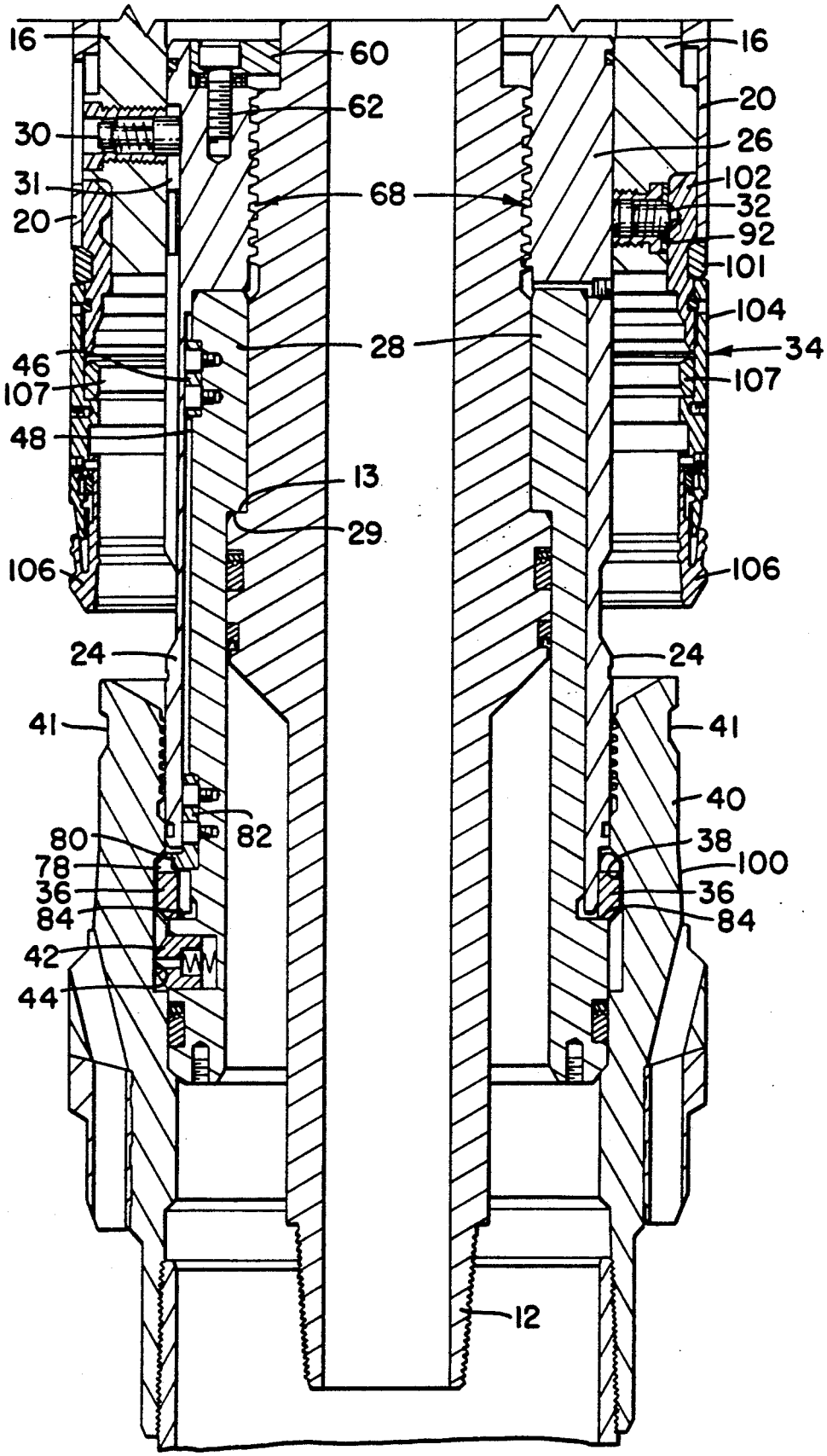

As seen best in FIGS. 1 and 2, a single trip casing hanger and packoff running tool 10 according to the present invention comprises a tubular inner mandrel 12 with internal threads 14 at its upper end for attaching it to a drill or other pipe string (not shown) employed to run and retrieve the tool from a surface location, an annular outer body 16 surrounding the inner mandrel 12 and rotatably retained thereon by an annular cap body retainer 18 threaded onto the mandrel 12, an outer sleeve 20 surrounding and releasably secured to the outer body by a plurality of shear pins 22, a tubular locking mandrel 24 surrounding the inner mandrel 12 and having an upper portion 26 located between the inner mandrel and the outer body 16, and a tubular inner body 28 surrounding the lower portion of the inner mandrel 12 and surrounded by the lower portion of the locking mandrel 24. A plurality (preferably two) of circumferentially spaced spring-biased anti-rotation pins 30 (only one shown) in the outer body 16 cooperate with a plurality of circumferentially spaced (preferably four) axial slots 31 (only one shown) on the outer surface of the locking mandrel 24 to prevent relative rotation between the outer body and that mandrel when the pins are in their functional position (FIGS. 1–4), and a plurality (preferably four) of circumferentially spaced packoff lock pins 32 (only one shown) in the outer body 16 releasably connect an annulus packoff 34 (FIGS. 2B) to the running tool when in their functional position.

The tool 10 further includes a split lock ring 36 carried by the inner body 28 and expandable into a groove 38 (FIG. 2B) in a casing hanger 40 to releasably attach the hanger to the tool, and a plurality (preferably three) of circumferentially spaced spring-biased anti-rotation pins 42 (only one shown) in the inner body 28 to prevent rotation between the inner body and the casing hanger 40 when in their functional position in axial slots 44 in the hanger. In addition, the tool 10 includes a plurality (preferably two) of circumferentially spaced anti-rotation keys 46 (only one shown) on the inner body 28 that cooperate with axial grooves 48 in the locking mandrel 24 to prevent relative rotation, yet facilitate relative axial movement, between the body 28 and mandrel 24. An annular sleeve 50, surrounding the upper portion of the outer body 16 and retained thereon by a snap ring 52, serves as a retainer for the outer sleeve 20. In order to facilitate flushing out the annular chamber 54 between the outer body 16 and the inner mandrel 12, a wash port 56 with a removable wash plug 58 are provided in the upper end of the outer body. A stop key 60 (FIGS. 1B, 2B), secured to the upper end of the locking mandrel 24 by a cap screw 62, cooperates with a stop lug 64 on the inner mandrel 12 to rotationally position the inner mandrel with respect to the locking mandrel during the procedure for landing the packoff 34, as will be more fully described later.

Figure 5:
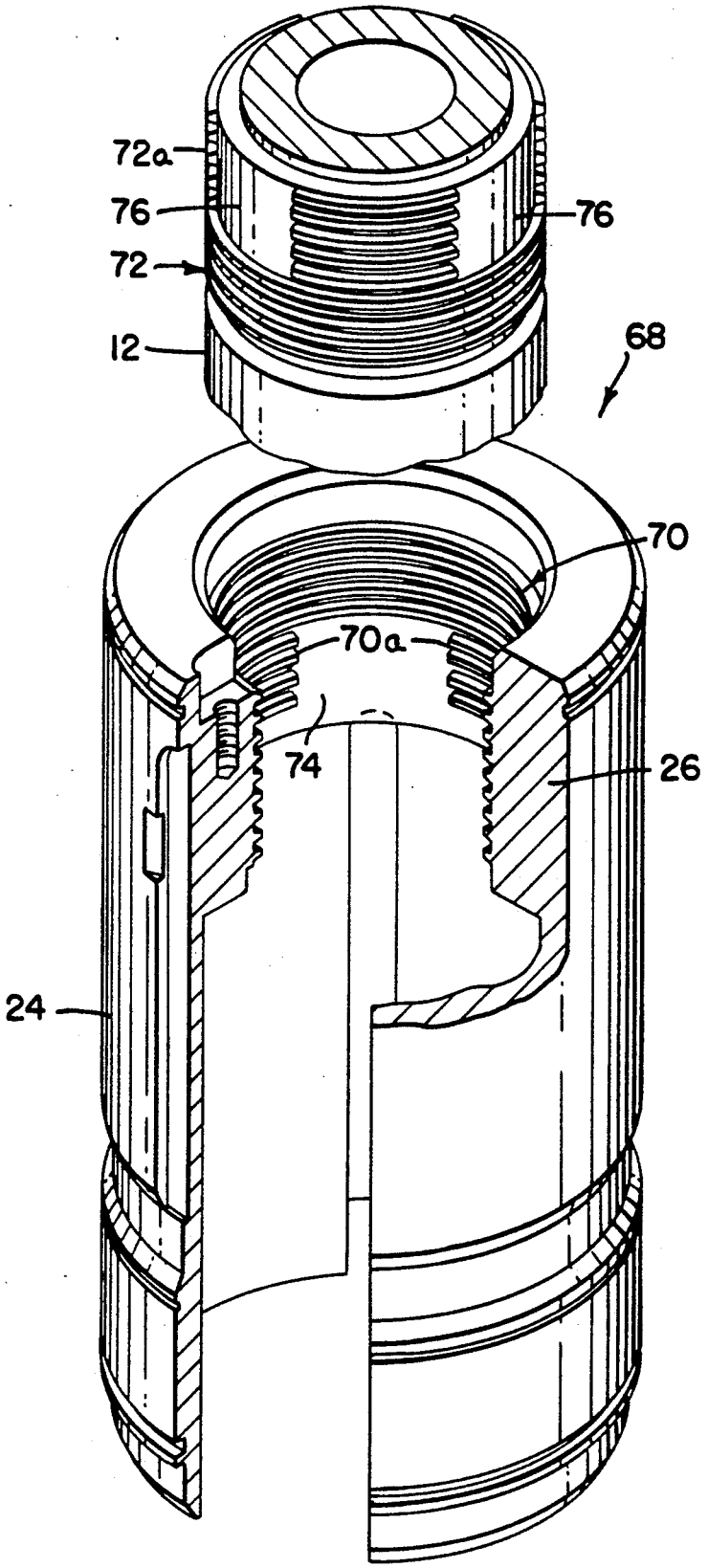
FIG. 5 is an isometric fragmentary view, partially in section, of the running tool inner mandrel and locking mandrel, showing the breech-block threads for interconnecting these elements.

The inner mandrel 12 and the locking mandrel 24 are inter-connected by a breech-block thread system 68 comprising internal threads 70 (FIG. 5) on the locking mandrel and external threads 72 on the inner mandrel. As illustrated in FIG. 5, the lower half 70*a* of the threads 70 are discontinuous because of three circumferentially spaced non-threaded axial slots 74, and in like manner the upper half 72*a* of the threads 72 are discontinuous because of three circumferentially spaced non-threaded axial slots 76. The slots 74, 76 facilitate axial movement of the inner mandrel 12 partially through the locking mandrel 24 without rotation of either element, whereas when any portion of the threads 70 is engaged with any portion of the threads 72 the mandrels can move axially with respect to each other only during relative rotational movement between them.

The lower end of the locking mandrel 24 functions to expand the lock ring 36 into its functional locking position in the hanger groove 38 (FIGS. 2B and 3) when the mandrel moves downwardly with respect to the inner body 28. The lock ring 36 has a plurality (preferably two) of circumferentially spaced radial slots 78 in its upper end into which extend the radial or "foot" portions 80 of a plurality (preferably two) of circumferentially spaced keys 82 on the outer surface of the inner body 28, these foot portions functioning to hold the lock ring down on the radial surface or shoulder 84 of the inner body. The keys 82 also cooperate with the locking mandrel grooves 48 to provide an anti-rotation function between the inner body 28 and the locking mandrel 24 when the keys and slots are engaged.

CASING HANGER/PACKOFF RUNNING PROCEDURE

Using the tool 10 to run, land and set the casing hanger 40 and the packoff assembly 34 in a wellhead housing 90 (FIG. 3) is accomplished as follows. The tool inner mandrel 12 is threaded onto a pipe string (not shown) and suspended above the floor of the drilling platform (not shown). The outer body 16 is rotated until the packoff lock pins 32 move inward into the locking mandrel slots 31, the packoff assembly 34 is positioned around the lower end of the outer body 16, and the outer body is then rotated to force the lock pins 32 outward from the slots 31 into a groove 92 in the packoff, thereby releasably connecting the packoff to the tool and allowing the anti-rotation pins 30 to move inward into the slots 31. With the locking mandrel 24 in a raised position with respect to rest of the tool elements (FIG. 4) and the lock ring 36 in its retracted condition, the tool 10 is then lowered into and landed on the casing hanger 40 and the inner mandrel 12 then rotated to the left, causing descent of the locking mandrel 24 which forces the lock ring 36 to expand into the hanger groove 38, thereby releasably connecting the hanger to the tool (FIG. 2B).

The tool, hanger and packoff are then lowered as a unit into the wellhead housing 90 (FIG. 3) until the hanger shoulder 94 lands on the upper annular surface 96 of a previously installed casing hanger 98 or on a landing seat (not shown) in the housing bore. The running string is then rotated to the right, simultaneously rotating the tool's inner mandrel 12 to the right and causing it to thread downwardly with respect to the locking mandrel 24. As the inner mandrel moves downward it causes the outer body 16 and packoff 34 to likewise descend until the packoff lands on the outer frusto-conical surface 100 of the casing hanger 40. The weight of the running string, the inner mandrel 12 and the outer body 16 are then imposed through the outer sleeve 20 and a packoff-to-wellhead lockdown ring 101 onto a packoff energizing mandrel 104, energizing a packoff seal 106 into sealing engagement with the hanger 40 and the housing 90.

Figure 3:
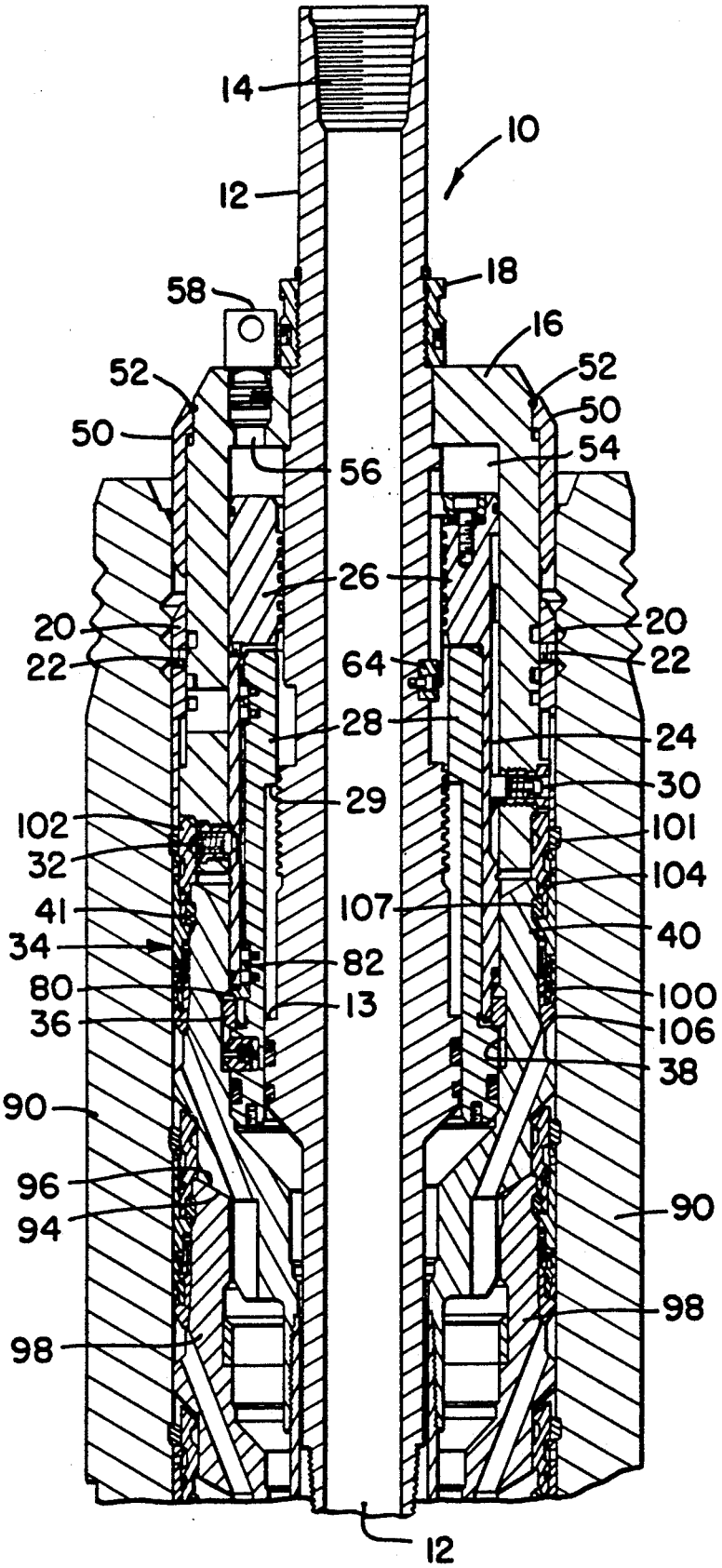
FIG. 3 is a view in central vertical section, on a reduced scale, showing the running tool, casing hanger and packoff of FIGS. 2A and 2B in a wellhead housing with the hanger and packoff set in their functional positions.
Figure 4:
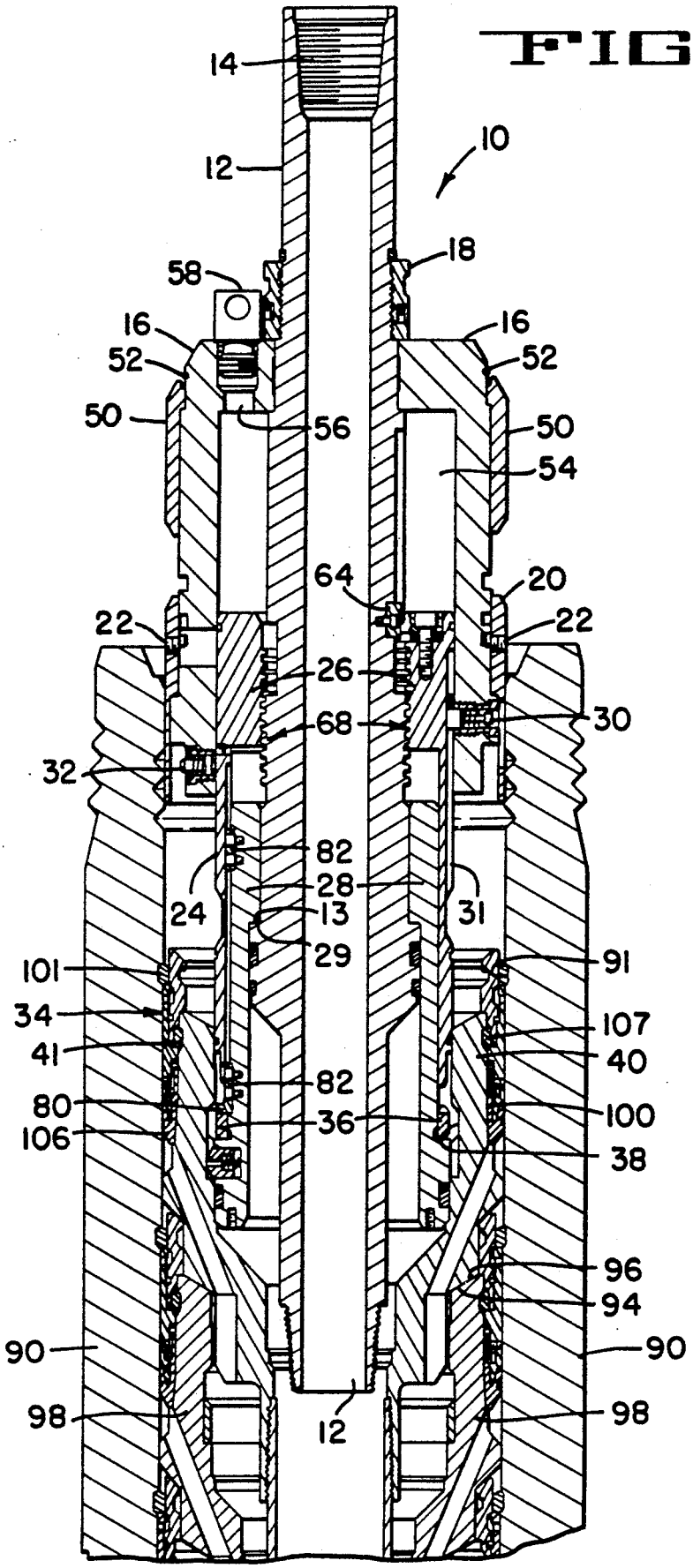
FIG. 4 is a view like FIG. 3 but showing the running tool disconnected from the packoff and hanger and ready for retrieval from the wellhead housing.

When the downward force on the outer body 16 exceeds the strength of the shear pins 22 these pins shear, letting the outer body 16 and inner mandrel 12 continue to descend and drive the packoff locking mandrel 102 downward. This downward force on the outer body 16 is produced by closing the blowout preventer (BOP) rams or the annular (neither shown) around the running string and pressurizing the annular space between the tool and the preventers. All the elements of the packoff assembly 34, except the seal 106, move further downward until the packoff's wellhead lockdown ring 101 is aligned with a wellhead housing groove 91 and the packoff's hanger lockdown ring 107 is aligned with an annular groove 41 on the hanger 40, whereupon the ring 101 expands into the groove 91 and the ring 107 contracts into the groove 41 as the locking mandrel 102 moves even further downward, locking the packoff to the wellhead housing and the hanger (FIG. 3). At this point the casing hanger 40 and the packoff 34 are fully installed in the wellhead housing 90. When the packoff 34 is in set position (FIG. 3) the location of the outer body 16 is such that the packoff lock pins 32 are retracted into an annular groove 25 in the locking mandrel 24, releasing the tool 10 from the packoff.

The running tool 10 is then disengaged from the packoff 34 and hanger 40 by lifting straight up on the running string. As the inner mandrel 12 rises it carries the outer body 16 upward. When the breech block threads 72 of the inner mandrel contact the threads 70 of the locking mandrel the locking mandrel moves upward from behind the lock ring 36, permitting the ring to retract out of the hanger groove 38 and releasing the tool from the hanger. Continued upward motion causes a shoulder 13 on the inner mandrel to contact a shoulder 29 on the inner body, lifting the tool out of the hanger.

The tool can then be retrieved to the surface by continued lifting, without any need for rotation, of the running string.

Although the best mode contemplated for carrying out the present invention has been herein shown and described, it will be apparent that modification and variation may be made without departing from what is regarded to be the subject matter of the invention.

What is claimed is:

1. A well tool for running a casing hanger and an annulus packoff into a wellhead housing, said tool comprising an assembly of:

a) a tubular inner mandrel with means to connect it to a pipe running string;

b) an annular outer body surrounding the inner mandrel;

c) an outer sleeve surrounding the outer body;

d) a tubular locking mandrel surrounding an upper portion of the inner mandrel;

e) a tubular inner body surrounding a lower portion of the inner mandrel and surrounded by a lower portion of the tubular locking mandrel;

f) means to prevent relative rotation between the outer body and the locking mandrel;

g) means on the outer body to attach an annulus packoff to the tool; and h) means on the inner body to attach a casing hanger to the tool.

2. A well tool according to claim 1 including interconnecting means to rotatably interconnect the inner mandrel and the locking mandrel.

3. A well tool according to claim 2 wherein the interconnecting means comprises a thread system.

4. A well tool according to claim 2 wherein the interconnecting means comprises a breech-block thread system.

5. A well tool according to claim 2 wherein the interconnecting means comprises breech-block threads and conventional threads on both the inner and locking mandrels.

6. A well tool according to claim 5 wherein the breech-block and conventional threads are positioned to facilitate continuous threading of the inner mandrel threads through the locking mandrel threads.

7. A well tool according to claim 5 wherein the breech-block threads on the inner mandrel are positioned axially opposite to the position of the breech-block threads on the locking mandrel, whereby engagement of the breech-block threads can be accomplished prior to, simultaneously with or following engagement of the continuous threads.

8. A well tool according to claim 1 including anti-rotation means to prevent rotation of the inner body with respect to the casing hanger.

9. A well tool according to claim 8 wherein the anti-rotation means comprises at least one spring-biased anti-rotation pin in the inner body.

10. A well tool according to claim 1 including anti-rotation means to prevent rotation of the inner body with respect to the locking mandrel.

11. A well tool according to claim 10 wherein the anti-rotation means comprises at least one anti-rotation key fixed to the inner body.

12. A well tool according to claim 1 wherein the means to prevent relative rotation between the outer body and the locking mandrel comprises at least one spring-biased anti-rotation pin in the outer body.

13. A well tool according to claim 1 wherein the means to attach an annular packoff to the tool comprises at least one spring-biased lock pin in the outer body.

14. A well tool according to claim 1 wherein the means to attach a casing hanger to the tool comprises a split lock ring.

15. A well tool according to claim 14 wherein the lock ring is inherently biased into its contracted condition and expands therefrom in response to a force exerted by the locking mandrel.

16. A well tool according to claim 1 wherein the outer body is rotatably connected to the inner mandrel.

17. A well tool according to claim 1 including shearable means interconnecting the outer sleeve to the outer body.

18. A well tool according to claim 1 including shoulder means on the inner mandrel and cooperating shoulder means on the inner body to limit axial movement of the inner mandrel in one direction with respect to the inner body.

19. A well tool according to claim 1 wherein the means to prevent relative rotation between the outer body and the locking mandrel comprises at least one anti-rotation pin in the outer body, wherein the means to attach a packoff to the tool comprises at least one lock pin in the outer body, and wherein said anti-rotation pin and said lock pin are actuated by rotation of said outer body with respect to the inner body.

20. A well tool according to claim 19 wherein the inner body includes at least one axial slot into which either the anti-rotation pin or the lock pin extends depending upon the location of said pins with respect to said slot.

* * * * *